US010654685B2

(12) United States Patent
Fauconnet

(10) Patent No.: US 10,654,685 B2
(45) Date of Patent: May 19, 2020

(54) CAR MOUNTED GOVERNOR FOR AN ELEVATOR SYSTEM

(71) Applicants: Aurélien Fauconnet, Isdes (FR); Otis Elevator Company, Farmington, CT (US)

(72) Inventor: Aurélien Fauconnet, Isdes (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/500,958

(22) PCT Filed: Aug. 1, 2014

(86) PCT No.: PCT/IB2014/001840
§ 371 (c)(1),
(2) Date: Feb. 1, 2017

(87) PCT Pub. No.: WO2016/016680
PCT Pub. Date: Feb. 4, 2016

(65) Prior Publication Data

US 2017/0225923 A1 Aug. 10, 2017

(51) Int. Cl.
*B66B 5/16* (2006.01)
*B66B 5/04* (2006.01)
(Continued)

(52) U.S. Cl.
CPC ..... *B66B 5/044* (2013.01); *B66B 5/0087* (2013.01); *B66B 5/042* (2013.01); *B66B 5/16* (2013.01); *B66B 9/00* (2013.01); *B66B 11/0246* (2013.01)

(58) Field of Classification Search
CPC ..... B66B 5/044; B66B 5/0087; B66B 5/042; B66B 5/16; B66B 9/00; B66B 11/0246
See application file for complete search history.

(56) References Cited

U.S. PATENT DOCUMENTS 403,668 A * 5/1889 Morris et al. ..... G05G 17/00 74/2
3,695,396 A * 10/1972 Jones ..... B66B 5/04 187/373

(Continued)

FOREIGN PATENT DOCUMENTS

DE 1936579 A1 2/1970
EP 1870368 A1 12/2007

(Continued)

OTHER PUBLICATIONS

Notification of Transmittal of the International Search Report and the Written Opinion of the International Searching Authority, or the Declaration, Application No. PCT/IB2014/001840; dated Mar. 27, 2015; 11 pages.

*Primary Examiner* — Michael A Riegelman
(74) *Attorney, Agent, or Firm* — Cantor Colburn LLP

(57) ABSTRACT

A car mounted governor (12) for an elevator system includes an overspeed pulley (38) configured to be secured to an elevator car of an elevator system. The overspeed pulley is configured to detect an overspeed condition of the elevator car via a rate at which a governor cable (42) passes around the overspeed pulley. The car mounted governor further includes a free pulley (40) configured to be secured to the elevator car with the governor cable routed over the free pulley. A tensioning device (64) is located at the free pulley and is operably connected thereto to maintain a select tension on the governor cable.

9 Claims, 5 Drawing Sheets

(51) Int. Cl.

| | |
|---|---|
| ***B66B 5/00*** | (2006.01) |
| ***B66B 9/00*** | (2006.01) |
| ***B66B 11/02*** | (2006.01) |

(56) References Cited

U.S. PATENT DOCUMENTS

| | | | | | |
|---|---|---|---|---|---|
| 4,662,481 | A * | 5/1987 | Morris | B66B 5/044 | 187/373 |
| 5,052,523 | A * | 10/1991 | Ericson | B66B 5/044 | 187/350 |
| 5,299,661 | A * | 4/1994 | Pramanik | B66B 5/044 | 187/373 |
| 5,377,786 | A * | 1/1995 | Nakagawa | B66B 5/044 | 187/276 |
| 5,458,216 | A * | 10/1995 | Tanaka | B66B 1/3492 | 187/373 |
| 6,318,506 | B1 * | 11/2001 | Marte | B66B 5/044 | 187/373 |
| 6,360,847 | B1 * | 3/2002 | Okada | B66B 5/044 | 187/373 |
| 6,564,907 | B1 * | 5/2003 | Sasaki | B66B 5/04 | 187/286 |
| 6,619,435 | B1 * | 9/2003 | Watzke | B66B 5/04 | 187/350 |
| 8,136,795 | B2 * | 3/2012 | Dube | B66B 5/044 | 187/373 |
| 8,342,294 | B2 * | 1/2013 | Madoz Michaus | B66B 5/044 | 187/359 |
| 2001/0040071 | A1 * | 11/2001 | Sasaki | B66B 5/044 | 187/373 |
| 2002/0125078 | A1 * | 9/2002 | Sasaki | B66B 5/044 | 187/373 |
| 2010/0059319 | A1 * | 3/2010 | Aguado | B66B 5/044 | 187/414 |
| 2013/0098711 | A1 * | 4/2013 | Aguado | B66B 5/044 | 187/373 |
| 2013/0220739 | A1 * | 8/2013 | Okada | B66B 5/04 | 187/254 |
| 2017/0073190 | A1 * | 3/2017 | Dube | B66B 5/16 | |
| 2017/0225923 | A1 * | 8/2017 | Fauconnet | B66B 5/044 | |

FOREIGN PATENT DOCUMENTS

| | | | |
|---|---|---|---|
| EP | 1900673 | A1 | 3/2008 |
| JP | H04125278 | A | 4/1992 |
| JP | 04125278 | U | 11/1992 |
| JP | 2002179361 | A | 6/2002 |
| JP | 2012062124 | A | 3/2012 |
| WO | 2013180721 | A1 | 12/2013 |

* cited by examiner

CAR MOUNTED GOVERNOR FOR AN ELEVATOR SYSTEM

CROSS REFERENCE TO RELATED APPLICATIONS

This application claims priority to PCT Patent Application No. PCT/IB2014/001840 filed Aug. 1, 2014, the entire contents of which is incorporated herein by reference.

BACKGROUND OF THE INVENTION

The subject matter disclosed herein relates to elevator systems. More particularly, the present disclosure relates to speed governors for elevator systems.

Typical elevator systems include a governor device to control a speed of an elevator car in a hoistway. The governor device may be connected to an elevator safety to slow and/or stop the movement of the elevator car in the case of an overspeed condition. In some systems, the governor device is mounted at, for example, the machine level of the elevator system or in a hoistway pit, while in other elevator systems the governor device is located at the elevator car itself, and is called a car-mounted governor.

In elevator systems with car-mounted governors, the governor cable is suspended from a fixed point at the top of the hoistway, and passes through the governor device at the elevator car. The governor cable is attached to a tension weight, located in the pit at the bottom of the hoistway, to maintain tension on the governor cable. With the governor device and/or tension weight located in the hoistway, the typical governor device requires that periodic inspection, maintenance and/or repair be performed by a technician entering the hoistway. Regulatory bodies have specified increases in safety volume and clearance for technicians entering the hoistway resulting in a larger overall volume of such elevator systems, while elevator system customers desire that the elevator system occupy a smaller overall volume.

BRIEF DESCRIPTION OF THE INVENTION

In one embodiment, a car mounted governor for an elevator system includes an overspeed pulley configured to be secured to an elevator car of an elevator system. The overspeed pulley is configured to detect an overspeed condition of the elevator car via a rate at which a governor cable passes around the overspeed pulley. The car mounted governor further includes a free pulley configured to be secured to the elevator car with the governor cable routed over the free pulley. A tensioning device is located at the free pulley and is operably connected thereto to maintain a select tension on the governor cable.

Additionally or alternatively, in this or other embodiments the tensioning device includes a movable mounting location for the free pulley and a biasing member operably connected to the free pulley to bias a location of the free pulley to maintain the select tension on the governor cable.

Additionally or alternatively, in this or other embodiments the biasing member is a tension weight fixed to the free pulley.

Additionally or alternatively, in this or other embodiments the free pulley is slidably secured in a mounting slot.

Additionally or alternatively, in this or other embodiments the mounting slot is vertically extending.

Additionally or alternatively, in this or other embodiments the governor is accessible from inside of the elevator car.

Additionally or alternatively, in this or other embodiments the overspeed pulley is operably connected to an elevator safety brake to slow or stop motion of the elevator car when an overspeed condition is detected by the overspeed pulley.

In another embodiment, an elevator system includes a hoistway and an elevator car suspending in the hoistway via a suspension member. A governor cable is suspended in the hoistway. A governor assembly is fixed to the elevator car and includes an overspeed pulley configured to detect an overspeed condition of the elevator car travel in the hoistway via a rate at which the governor cable passes around the overspeed pulley. A free pulley is secured to the elevator car with the governor cable routed around the free pulley. A tensioning device is located at the free pulley and is operably connected thereto to maintain a select tension on the governor cable.

Additionally or alternatively, in this or other embodiments the tensioning device includes a movable mounting location for the free pulley and a biasing member operably connected to the free pulley to bias a location of the free pulley to maintain the select tension on the governor cable.

Additionally or alternatively, in this or other embodiments the biasing member is a tension weight fixed to the free pulley.

Additionally or alternatively, in this or other embodiments the free pulley is slidably secured in a mounting slot.

Additionally or alternatively, in this or other embodiments the mounting slot is vertically extending.

Additionally or alternatively, in this or other embodiments the governor is accessible from inside of the elevator car.

Additionally or alternatively, in this or other embodiments the overspeed pulley is operably connected to an elevator safety brake to slow or stop motion of the elevator car when an overspeed condition is detected by the overspeed pulley.

Additionally or alternatively, in this or other embodiments the governor cable is fixed at an upper mounting location at a top of the hoistway and at a lower mounting location at a bottom of the hoistway.

The detailed description explains the invention, together with advantages and features, by way of examples with reference to the drawings.

DETAILED DESCRIPTION OF THE INVENTION

Figure 1A:
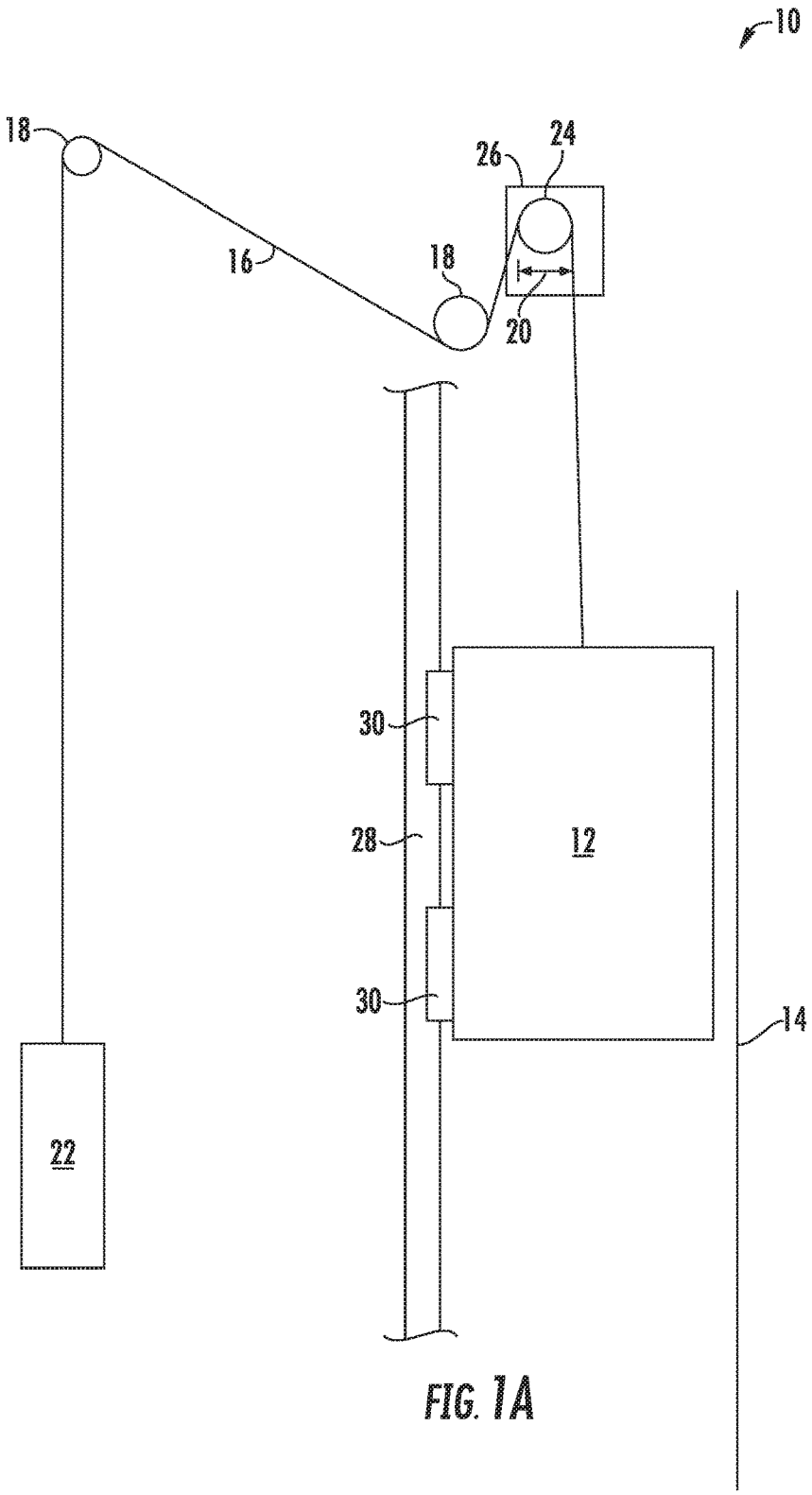
FIG. 1A is a schematic of an exemplary elevator system having a 1:1 roping arrangement.
Figure 1B:
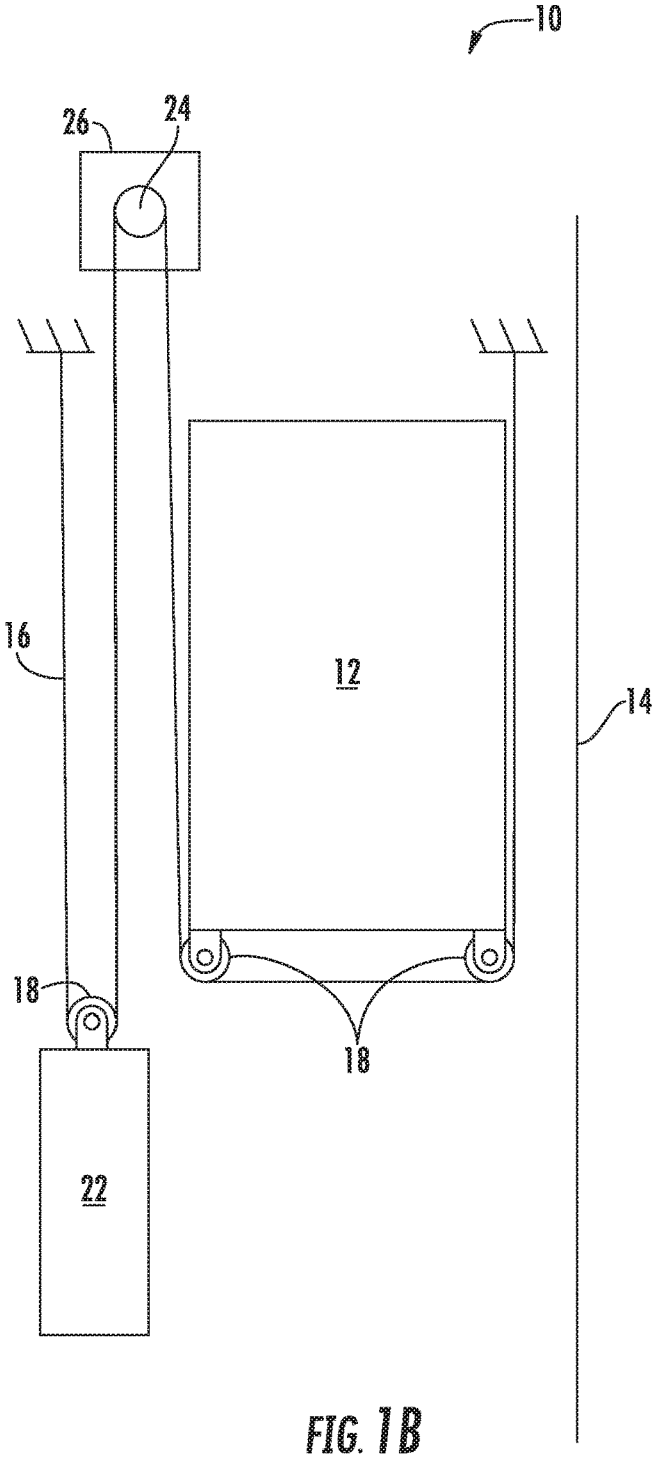
FIG. 1B is a schematic of another exemplary elevator system having a different roping arrangement.
Figure 1C:
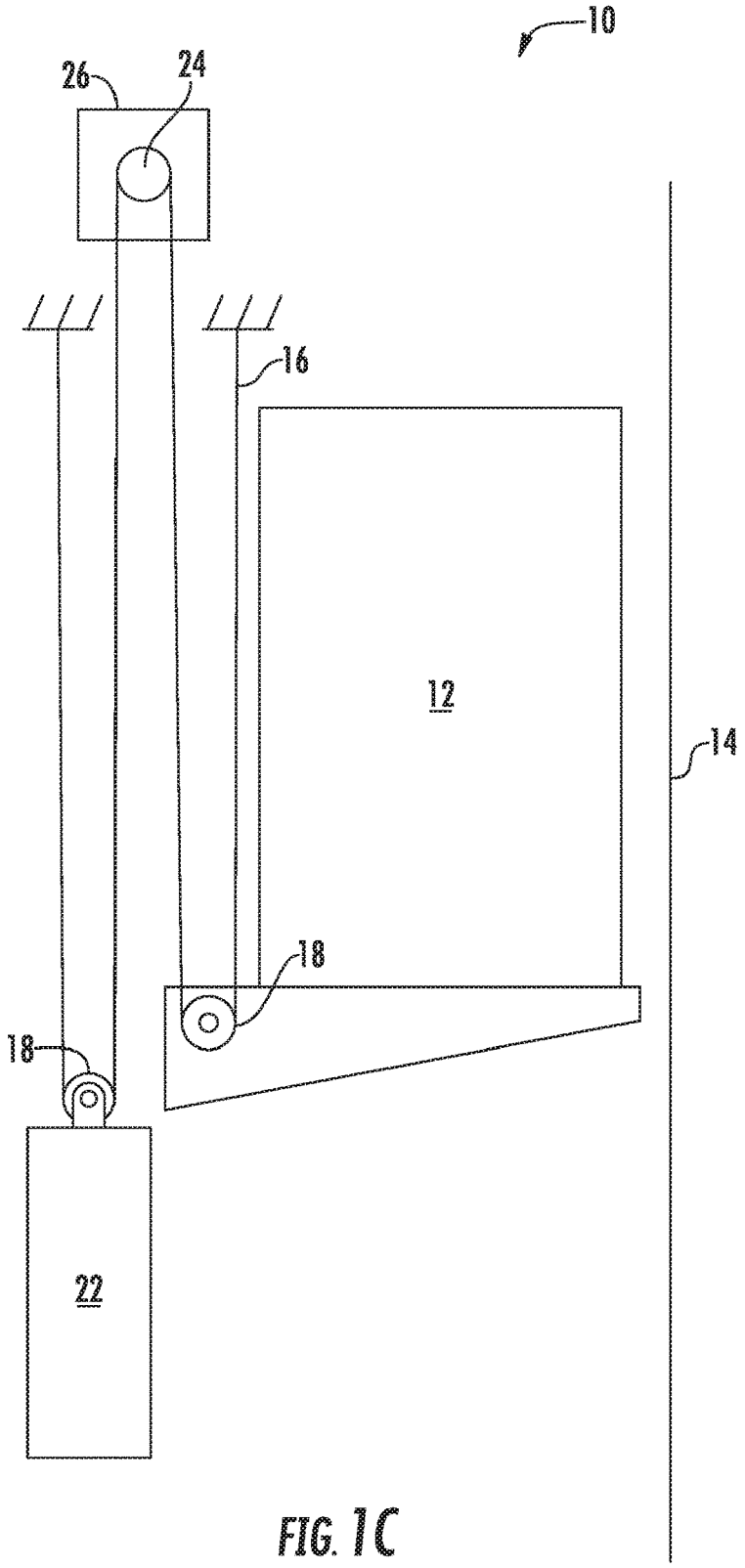
FIG. 1C is a schematic of another exemplary elevator system having a cantilevered arrangement.

Shown in FIGS. 1A, 1B and 1C are schematics of exemplary traction elevator systems 10. The elevator system 10 includes an elevator car 12 operatively suspended or supported in a hoistway 14 with one or more suspension members 16, such as ropes or belts. The one or more suspension members 16 interact with one or more sheaves 18 to be routed around various components of the elevator system 10. The one or more sheaves 18 could also be connected to a counterweight 22, which is used to help balance the elevator system 10 and reduce the difference in belt tension on both sides of a traction sheave 24 during operation.

The sheaves 18 each have a diameter 20, which may be the same or different than the diameters of the other sheaves 18 in the elevator system 10. At least one of the sheaves 18 could be a traction sheave 24. The traction sheave 24 is driven by a machine 26. Movement of traction sheave 24 by the machine 26 drives, moves and/or propels (through traction) the one or more belts 16 that are routed around the traction sheave 24.

At least one of the sheaves 18 could be a diverter, deflector or idler sheave. Diverter, deflector or idler sheaves are not driven by the machine 26, but help guide the one or more belts 16 around the various components of the elevator system 10.

Referring again to FIG. 1A, the elevator system 10 further includes one or more guide rails 28 to guide the elevator car 12 along the hoistway 14. The elevator car includes one or more guide shoes 30 interactive with the guide rails 28 to guide the elevator car 12, and also may include safeties 32 interactive with the guide rail 28 to slow and/or stop motion of the elevator car 12 under certain conditions, such as an overspeed condition.

Figure 2:
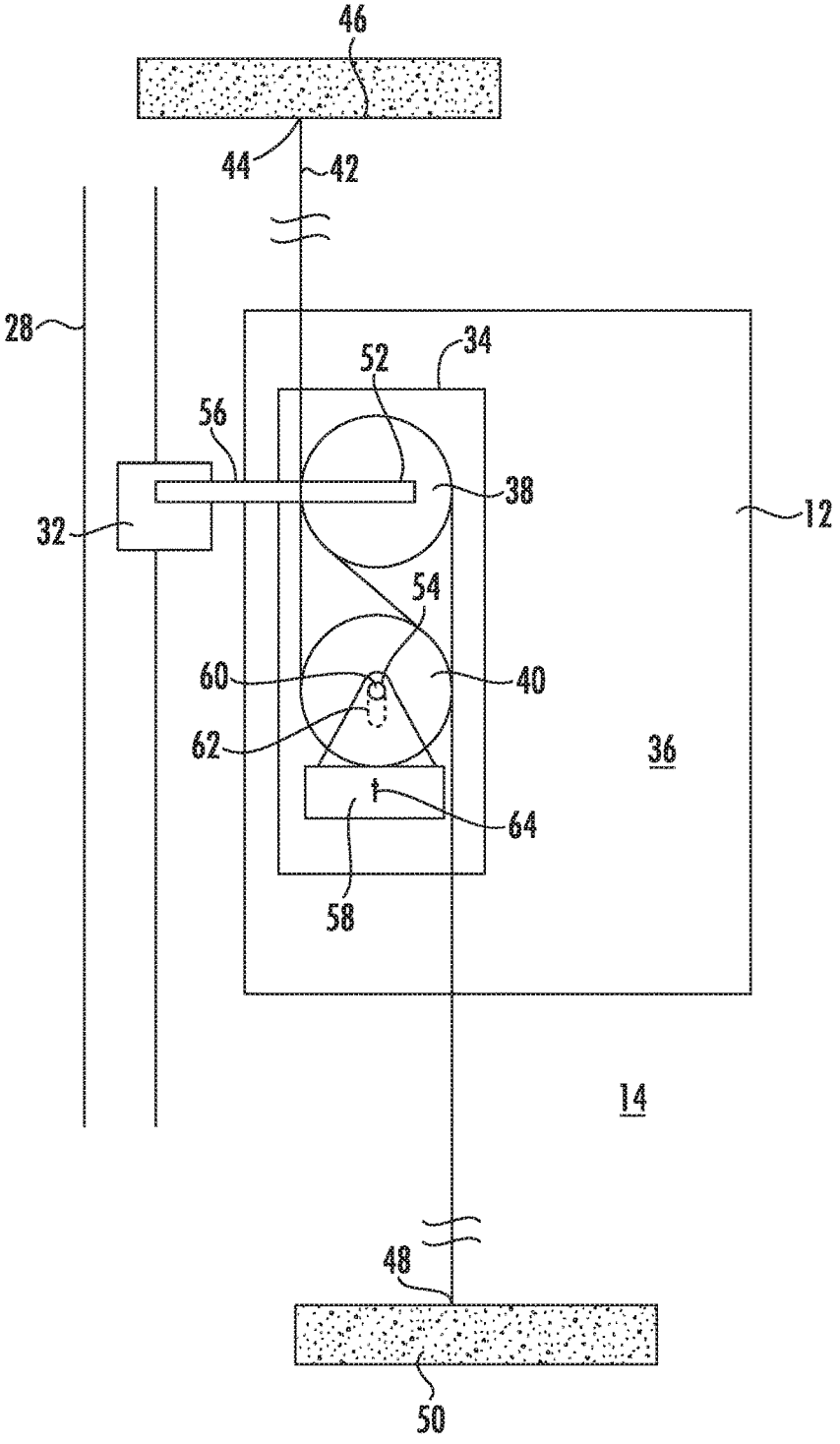
FIG. 2 is a schematic view of an embodiment of a car-mounted governor assembly for an elevator system.

Referring now to FIG. 2, the elevator system 10 includes a governor device 34 secured to the elevator car 12 at, for example, a sidewall 36 of the elevator car 12. The governor device 34 includes an overspeed pulley 38 and a free pulley 40 through which a governor cable 42 is routed. In some embodiments, the pulleys 38, 40 are located in a governor housing 58. The governor cable 42 is secured at an upper mounting location 44, a fixed point at, for example, a hoistway top 46. Further the governor cable 42 is secured at a lower mounting location 48 at, for example, a hoistway bottom 50. The overspeed pulley 38 and the free pulley 40 rotate about respective pulley axes 52, 54 as the elevator car 12 travels along the hoistway 14.

The rotation is driven by the passage of the governor cable 42 around the pulleys 38, 40 while the elevator car 12 is in motion. The overspeed pulley 38 is connected to the safeties 32 via, for example, a link arm 56. When the overspeed pulley 38 rotates about pulley axis 52 at a speed equal to or greater than a selected threshold speed, it is indicative of an overspeed condition in movement of the elevator car 12 along the hoistway 14. If the speed of the overspeed pulley 38 is equal to or greater than the threshold speed, a device at the overspeed pulley 38 such as a cam, a clutch, or switch (not shown) activates the safeties 32 via the link arm 56 to slow or stop the elevator car 12.

Figure 3:
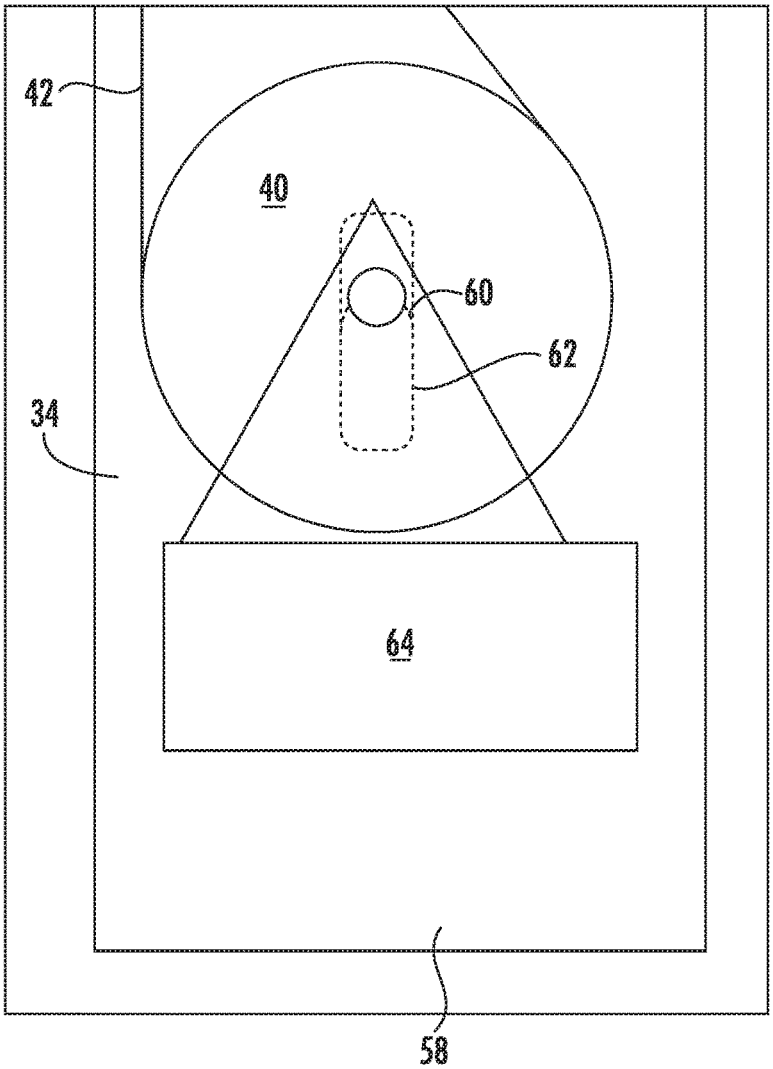
FIG. 3 is another schematic view of an embodiment of a car-mounted governor assembly for an elevator system.

Referring now to FIG. 3, maintaining a proper tension in the governor cable 42 is critical to proper operation of the governor device 34. Without proper tension in the governor cable 42, the overspeed pulley 38 will not operate properly and will not activate the safeties 32. While typical elevator systems utilize a weight suspended in a pit of the hoistway to maintain tension on the governor rope, in the present disclosure this is accomplished via features of the governor device 34 itself, in particular in the attachment of the free pulley 40 to the elevator car 12. The free pulley 40 is mounted such that it is movable in a vertical direction, such as a pulley shaft 60 mounted in a vertically extending slot 62 or groove in the governor housing 58 or alternatively in the elevator car 12. A tension weight 64 is connected to and suspended from the free pulley 40 to bias the free pulley 40 downwardly in the slot 62 thus providing tension on the governor cable 42 passing around and below the free pulley 40. Alternatively, an element such as a spring may be utilized to bias the free pulley location downwardly to maintain the select tension on the governor cable. Location of the tensioning device for the governor cable 42 at the elevator car 12, in particular at the governor itself, eliminates the need for the typical weight suspended from the governor cable and located in the hoistway pit, and allows for inspection, maintenance and repair of the governor via, for example, a panel 36 in the elevator car, thereby reducing instances where a service technician must enter the hoistway.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A car mounted governor for an elevator system comprising:

an overspeed pulley configured to be secured to an elevator car of the elevator system, the overspeed pulley configured to detect an overspeed condition of the elevator car via a rate at which a governor cable passes around the overspeed pulley;

a free pulley configured to be secured to the elevator car, the governor cable routed around the free pulley; and a tensioning device disposed at the free pulley and operably connected thereto to maintain a select tension on the governor cable, the tensioning device including:

a movable mounting location for the free pulley; and a biasing member operably connected to the free pulley to bias a location of the free pulley to maintain the select tension on the governor cable;

wherein the free pulley is slidably secured in a mounting slot.

2. The governor of claim 1, wherein the biasing member is a tension weight fixed to the free pulley.

3. The governor of claim 1, wherein the mounting slot is vertically extending.

4. The governor of claim 1, wherein the overspeed pulley is operably connected to an elevator safety brake to slow or stop motion of the elevator car when an overspeed condition is detected by the overspeed pulley.

5. An elevator system comprising:

a hoistway;

an elevator car suspending in the hoistway via a suspension member;

a governor cable suspended in the hoistway; and a governor assembly fixed to the elevator car including:

an overspeed pulley configured to detect an overspeed condition of the elevator car travel in the hoistway via a rate at which the governor cable passes around over the overspeed pulley;

a free pulley secured to the elevator car, the governor cable routed around the free pulley; and a tensioning device disposed at the free pulley and operably connected thereto to maintain a select tension on the governor cable, the tensioning device including:

a movable mounting location for the free pulley; and a biasing member operably connected to the free pulley to bias a location of the free pulley to maintain the select tension on the governor cable;

wherein the free pulley is slidably secured in a mounting slot.

6. The elevator system of claim 5, wherein the biasing member is a tension weight fixed to the free pulley.

7. The elevator system of claim 5, wherein the mounting slot is vertically extending.

8. The elevator system of claim 5, wherein the overspeed pulley is operably connected to an elevator safety brake to slow or stop motion of the elevator car when an overspeed condition is detected by the overspeed pulley.

9. The elevator system of claim 5, wherein the governor cable is fixed at an upper mounting location at a top of the hoistway and at a lower mounting location at a bottom of the hoistway.

* * * * *